US008099828B2

(12) United States Patent
Adelman et al.

(10) Patent No.: US 8,099,828 B2
(45) Date of Patent: Jan. 24, 2012

(54) EXTERNAL FILTER CHAMBER

(75) Inventors: Kurt Clarence Adelman, Sauk Rapids, MN (US); Karl Hansen, Cottage Grove, MN (US)

(73) Assignee: Tennant Company, Minneapolis, MN (US)

( * ) Notice: Subject to any disclaimer, the term of this patent is extended or adjusted under 35 U.S.C. 154(b) by 928 days.

(21) Appl. No.: 12/043,945

(22) Filed: Mar. 6, 2008

(65) Prior Publication Data

US 2008/0276412 A1 Nov. 13, 2008

Related U.S. Application Data

(60) Provisional application No. 60/893,364, filed on Mar. 6, 2007.

(51) Int. Cl.
*A47L 9/10* (2006.01)

(52) U.S. Cl. ..... 15/347; 15/340.1; 15/349; 15/78

(58) Field of Classification Search ..... 15/349, 15/327.1, 83, 49.1, 78, 87, 300.1, 347, 340.1; 55/307

See application file for complete search history.

(56) References Cited

U.S. PATENT DOCUMENTS

| | | | | | |
|---|---|---|---|---|---|
| 3,837,029 | A | | 9/1974 | Kasper | |
| 4,017,281 | A | * | 4/1977 | Johnstone | 55/334 |
| 4,514,875 | A | * | 5/1985 | Comer | 15/349 |
| 4,578,840 | A | * | 4/1986 | Pausch | 15/352 |
| 4,580,313 | A | * | 4/1986 | Blehert | 15/349 |
| 4,819,676 | A | | 4/1989 | Blehert et al. | |
| 5,013,333 | A | * | 5/1991 | Beaufoy et al. | 95/20 |
| 5,303,448 | A | | 4/1994 | Hennessey et al. | |
| 5,647,093 | A | * | 7/1997 | Engel et al. | 15/352 |
| 5,996,171 | A | * | 12/1999 | Bowers | 15/340.1 |
| 7,334,290 | B2 | | 2/2008 | Hawkins | |
| 2006/0053582 | A1 | | 3/2006 | Engel et al. | |

OTHER PUBLICATIONS

International Preliminary Report on Patentability for PCT/US2008/059018, mailed Aug. 16, 2010.

* cited by examiner

*Primary Examiner* — Dung Van Nguyen
(74) *Attorney, Agent, or Firm* — Briggs and Morgan, P.A.

(57) ABSTRACT

An external filter box for a surface maintenance machine having a hopper with selective communication being provided between the filter box and the hopper to permit dusty air to flow from the hopper to the filter box and to permit dust and debris captured by the filter box to flow into the hopper. In one example, the hopper includes a prefilter assembly which is coupled to an inlet of the filter box during a sweeping operation and which is removed away from the filter box during a hopper dump procedure.

21 Claims, 17 Drawing Sheets

EXTERNAL FILTER CHAMBER

RELATED APPLICATIONS

This application claims priority under 35 U.S.C. 119(e) from provisional U.S. Patent Application No. 60/893,364 filed Mar. 6, 2007 the contents of which are incorporated herein by reference.

TECHNICAL FIELD

The present disclosure is directed to filtration systems for mobile surface maintenance machines. More specifically, the present disclosure is directed to a filtration system utilizing a filter chamber external to the debris hopper.

BACKGROUND OF THE INVENTION

Over the years various kinds of machines have been developed for cleaning and maintaining floors inside buildings, and paved outdoor areas such as streets, sidewalks and parking lots. They include such machines as rotary broom sweepers, vacuum sweepers, scarifiers, burnishers, polishers and scrubbers. For our purposes here they can be divided into machines which apply water to the surface being maintained and machines which operate dry. We are concerned with the latter, which would include many vacuum sweepers, scarifiers, and rotary broom sweepers. They all share one problem which is addressed by this invention. In their normal operation they tend to stir up dust from the surface being maintained. If it is not controlled, this dust is highly objectionable.

On many of these machines the problem has received one general solution. The functional tool which generates the dust, such as a rotary broom, a scarifier head, or a vacuum pickup, is provided with a cover and surrounded by walls which have rubber skirts that hang down almost to the surface being maintained. An on board exhaust blower continuously pulls air from the tool chamber thus created so there is a sub-atmospheric air pressure within it which eliminates outflow of dusty air from under the skirts. The blower exhausts this air to atmosphere. One or more air filters are placed in this air path, either upstream or downstream from the blower, to remove dust from the air before it is released so the discharge to atmosphere will be dust free.

BRIEF SUMMARY OF THE INVENTION

The present invention is directed to a filtration system for a mobile surface maintenance machine utilizing a filter box which is external to the debris hopper. One or more filters are provided within a filtration system. The filter(s) can be cylindrical filters. The filter box also defines a vacuum impeller housing for efficiently drawing air through the cylindrical filter(s). In one embodiment, the debris hopper can be lifted away from the filter box, such as during a dumping procedure. In one embodiment, the external filter box is provided with selective communication with the debris hopper to allow dust and debris to move out of the filter box and be deposited within the debris hopper. The selective communication can include one or more flaps which respond to pressure variations across the flap in order to open or close the flap.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

A conventional forward throw rotary broom sweeper will be used by way of example in the following description of the invention. However, it should be understood that, as already stated, the invention could as well be applied to other types of mobile surface maintenance machines, such as, for example, other types of rotary broom sweepers, scarifiers, and various types of vacuum sweepers.

Figure 1:
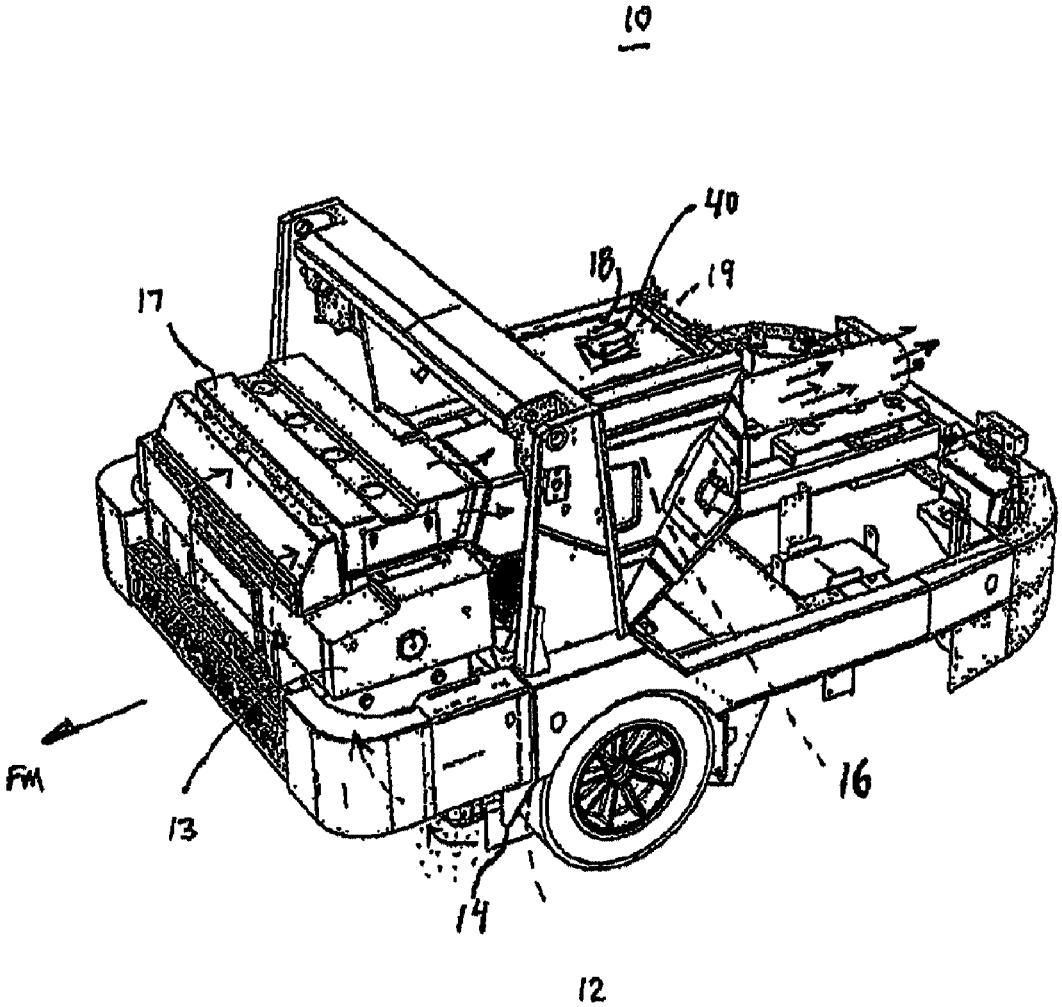
FIG. 1 is a perspective illustration of one embodiment of a cleaning machine utilizing a filter cleaning system in accordance with the present invention.

With reference to FIG. 1, there is shown an industrial sweeping machine 10. As illustrate, machine 10 is a forward throw sweeper with an intended direction of motion indicated by arrow marked FM. Machine 10 could as well be an over-the-top, rear hopper sweeper, a type which is also well known in the art. Machine 10 has a rotating cylindrical brush 12 for sweeping debris from a floor or other surface into a debris hopper 13. Hopper arms (not shown) allow hopper 13 to be lifted during a dumping procedure. The brush chamber generally encloses brush 12 under skirts 14 to control air flow around brush 12. The skirts 14 largely contain within the brush chamber any dust stirred up by the brush 12. To complete the dust control there is a suction blower or vacuum fan 16 which exhausts air from the brush chamber to atmosphere in an airflow path shown by the arrows in FIG. 1. Vacuum fan 16 is housed within filter box 18 and includes an impeller which is driven by the machine's hydraulic system. Vacuum fan 16 maintains a sub-atmospheric pressure within the brush chamber so that air is drawn in under the skirts rather than flowing out. Thus relatively little dust escapes from around skirts 14. During machine 10 operation, vacuum fan 16 draws debris and dust-entrained air through prefilter 17 and filter 19 contained within filter box 18 prior to exhaust. Prefilter 17 is located within debris hopper 13 and is separated from filter box 18 during, for example, a debris hopper 13 lift and dump operation. Shaker mechanism 40 is provided on filter box 18. Periodic activation of shaker mechanism shakes filter 19 to dislodge dust and debris. Various components of machine 10 have been left out of FIG. 1, e.g., the drive engine, housings and operator station have been omitted to improve understanding of the aspects of the present invention. Additional examples of surface maintenance machine suitable for adaptation in accordance with the present invention are found in U.S. Pat. Nos. 5,254,146 and 5,303,448, each patent being incorporated by reference herein for all purposes.

Figure 2:
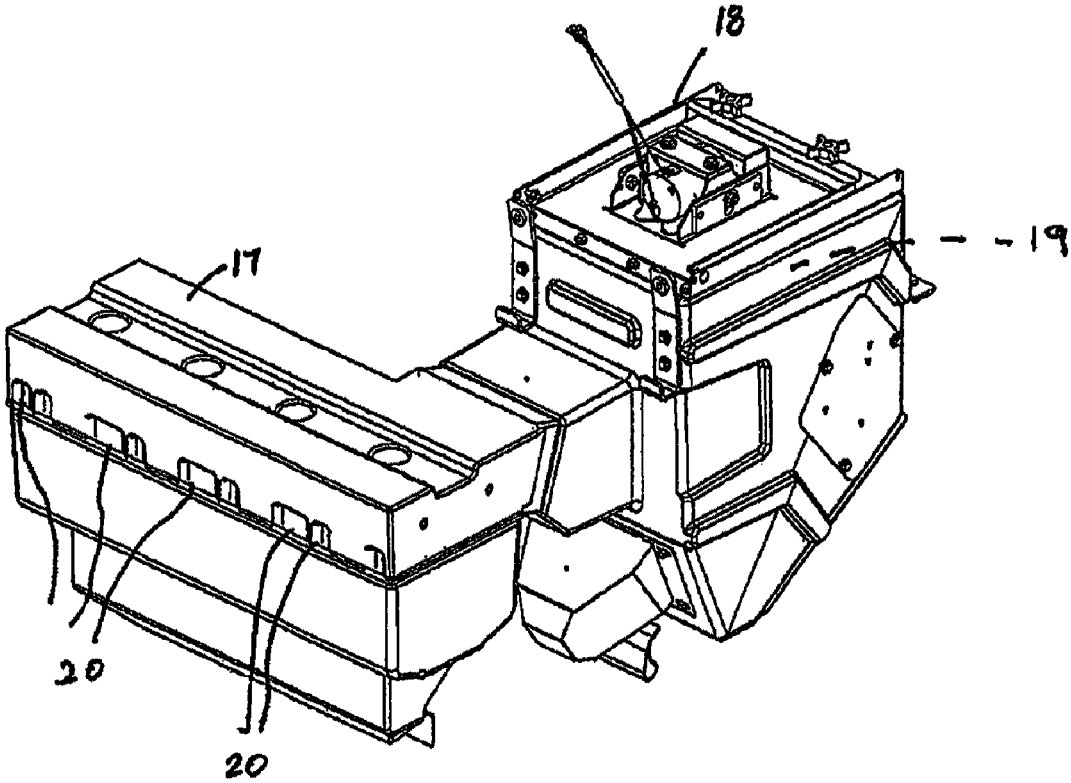
FIGS. 2 and 3 are perspective illustrations of the prefilter chamber and filter box of the cleaning machine of FIG. 1.

FIG. 2 is a perspective view of prefilter 17 and filter box 18. Filter box 18 houses cylindrical filter 19 as described in more detail hereinafter. Dust and debris-laden air is drawn by vacuum action into prefilter openings 20. Together the prefilter 17 and filter box 18 remove dust and/or debris from the air stream so the vacuum fan 16 will exhaust relatively clean air to atmosphere during machine 10 operation. Prefilter 17 may comprise a bank of cyclonic filters through which dusty air passes causing separation and retention of at least some of the larger dust particles and debris. Additional features of the prefilter 17 assembly can be found by reference to U.S. Ser. No. 60/893,560, entitled "Counter Rotating Cyclonic Filter", and incorporated by reference herein.

In a preferred embodiment, filter box 18 includes a cylindrical pleated media filter 19, such as are manufactured, for example, by Donaldson Company, Inc. of Minneapolis, Minn. Filter 19 has a pleated media, with the pleats running parallel to the centerline of the cylinder, which makes them vertical when installed as shown. The pleated media is surrounded with a perforated metal sleeve for structural integrity. Outside the metal sleeve may be provided a fine mesh sleeve (not shown) woven from a slippery synthetic filament which stops the coarser dust and sheds it easily during a filter cleaning cycle. The ends of the cylindrical filter are open. Other filter technologies could be utilized in alternative embodiments of filter box 18.

A preferred example of the invention utilizes a cylindrical pleated media filter. However, the invention will accommodate air filters of other types. An alternative design includes two or more flat panel pleated media filters, and other known types of air filters may also be successfully employed. These might include, for example, cloth filters formed into bags, envelopes or socks, which are well known types of filters in the field of air filtration.

Figure 3:
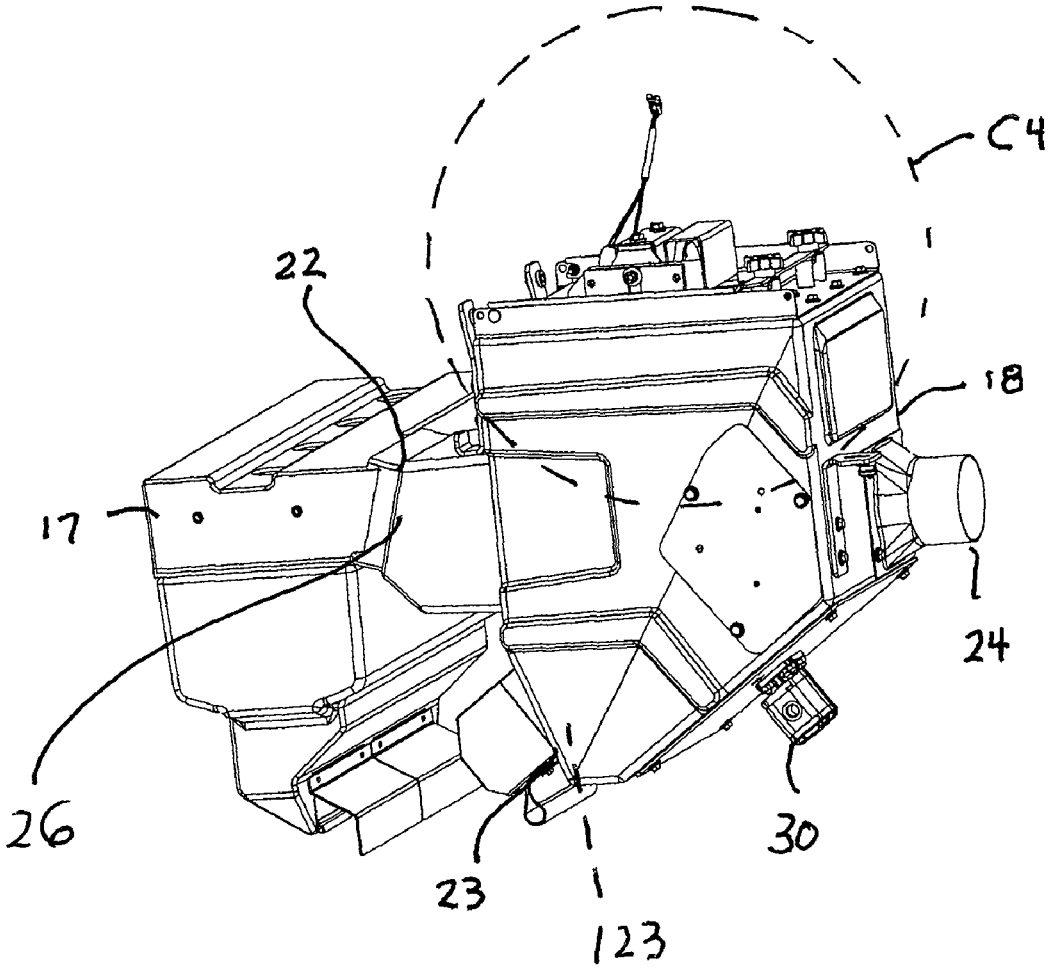

As shown in FIG. 3, filter box 18 has an intake opening 22 at the front of the machine 10 to admit air from the prefilter assembly 17. Intake opening 22 is located within an air conduit 26. As described hereinafter, air flow through the conduit 26 is terminated during a hopper dumping procedure as the hopper 13 is separated from and moved away from the filter box 18. As illustrated a flexible coupling, such as foam, is utilized to provide fluid communication between prefilter 17 and filter box 18. Dust and debris captured by filter box 18 is removable via a lower debris outlet port 23. Filter air is directed out of filter box 18 at air outlet 24. Upon deactivation of the vacuum system, an accumulation of dust and debris passes through a flap or seal 123 (shown in FIGS. 12, 13 and 14) at debris outlet port 23 and into the machine hopper 13 (not shown). During machine 10 operation, the debris outlet port seal 123 is kept closed by vacuum action. Filter box 18 includes vacuum fan motor 30 which is coupled to the vacuum impeller (not shown).

Figure 4:
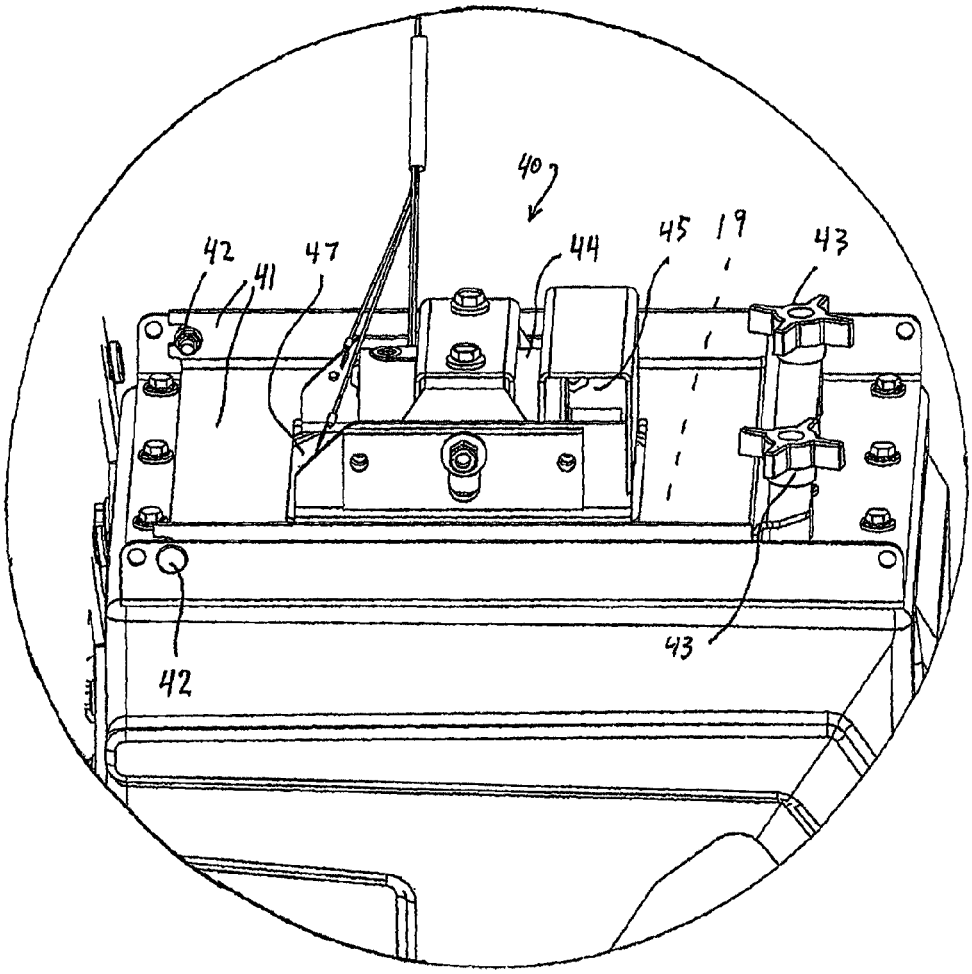
FIG. 4 is an enlarged portion of FIG. 3 contained within circle C4.

FIG. 4 is an enlarged portion of the filter box 18 showing details of shaker mechanism 40 as indicated by circle, C4, in FIG. 3. A hinged cover plate 41 is secured on top of filter box 18 by two hinge assemblies 42 and two clamp assemblies 43. When clamp assemblies 43 are released, cover plate 41 and connected components rotate about the hinges 42 to allow access into filter box 18. Cover plate 41 has a large generally rectangular opening in it corresponding to the general location of the cylindrical filter 19.

Shaker mechanism 40 includes an electric motor 44 coupled to an eccentric mass 45. Electric motor 44 is coupled to a shaker plate 47 which engages the top of filter 19. Shaker mechanism 40 also includes a vibration-isolating motor mount assembly which permits shaker plate 47 to vibrate generally independently relative to cover plate 41 during a filter shaking procedure.

Figure 5:
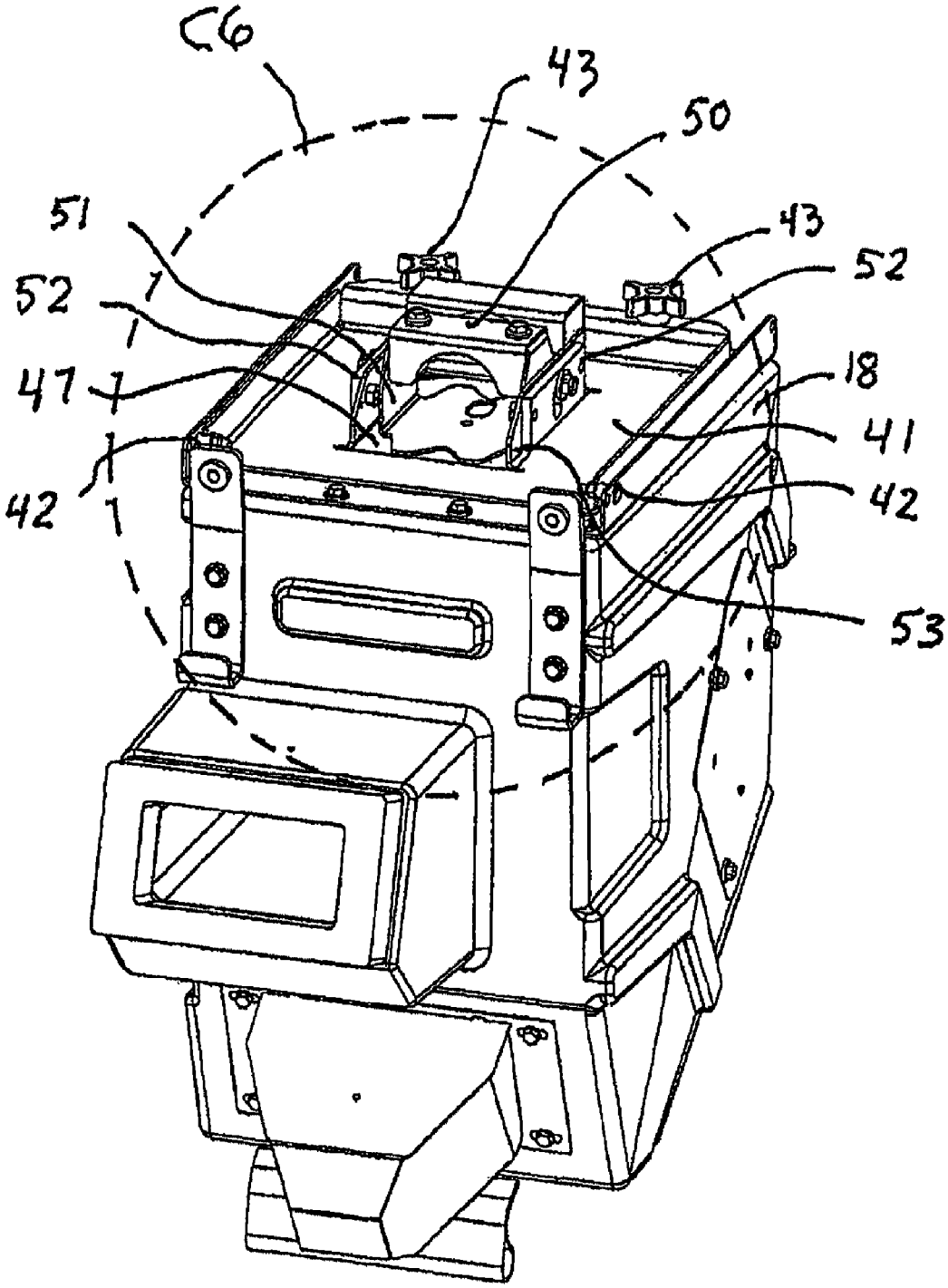
FIG. 5 is a perspective illustration of the prefilter chamber and filter box of FIG. 1.
Figure 6:
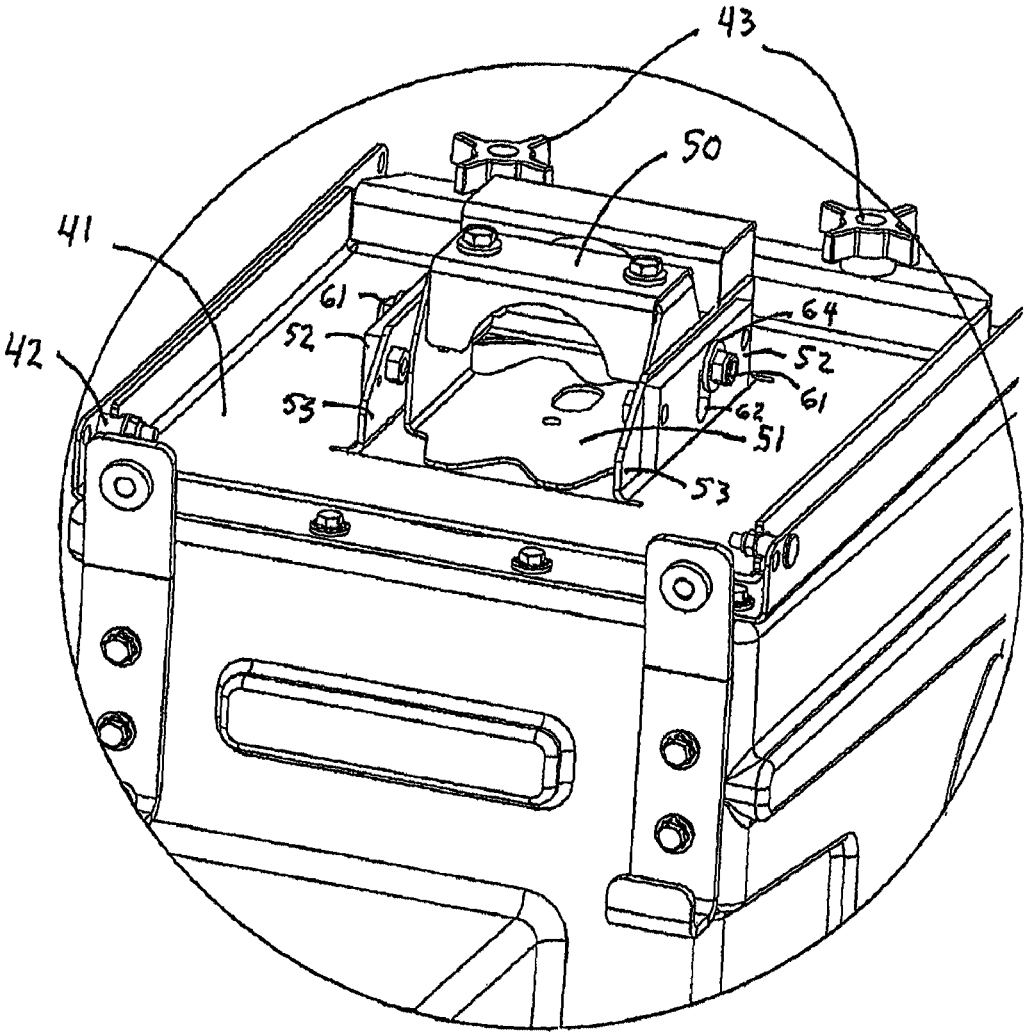
FIG. 6 is an enlarged portion of FIG. 5 contained within circle C6.

Referring to FIG. 5, the motor mount assembly includes a motor clamp 50, motor saddle 51, and a pair of slide plates 52 secured to upwardly directed flanges 53 of hinged cover plate 41. Electric motor 44 and eccentric mass 45 have been removed in this illustration. FIG. 6 is an enlarged portion of the filter box 18 assembly showing details of shaker mechanism 40 as indicated by circle, C6, in FIG. 5.

Motor 44 is secured between motor clamp 50 and saddle 51. Saddle 51 is rigidly coupled to shaker plate 47. Saddle 51 is movably coupled to slide plates 52 via a pair of fasteners 61. In this example, fasteners 61 are free to move within slots 62 to permit a generally vertical displacement of the saddle 51, clamp 50, motor 44 and eccentric mass 45 during a filter shaking procedure. Washers 64 slide against slide plates 52 as limited by slots 62.

Figure 7:
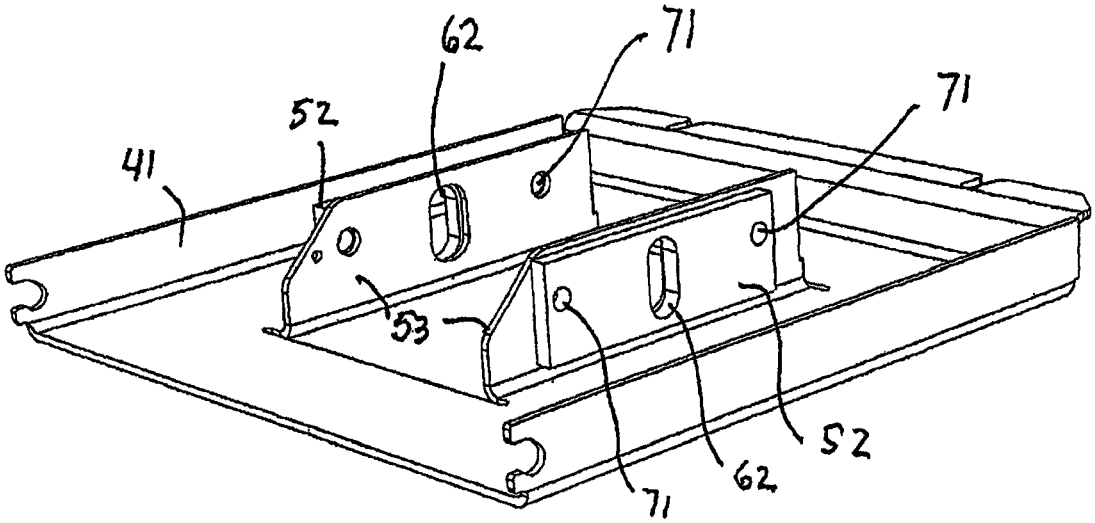
FIG. 7 is a perspective view of a cover component of the embodiment of FIG. 1.

FIG. 7 illustrates hinged filter cover plate 41 and slide plates 52. Fasteners (not shown) pass through openings 71 and secured slide plates 52 to flanges 53 of cover plate 41. Slots 62 extend through generally equally sized openings in slide plates 52 and flanges 53. In one example, slide plates 52 are of a durable material with substantially improved wear resistance relative to cover plate 41.

Figure 8:
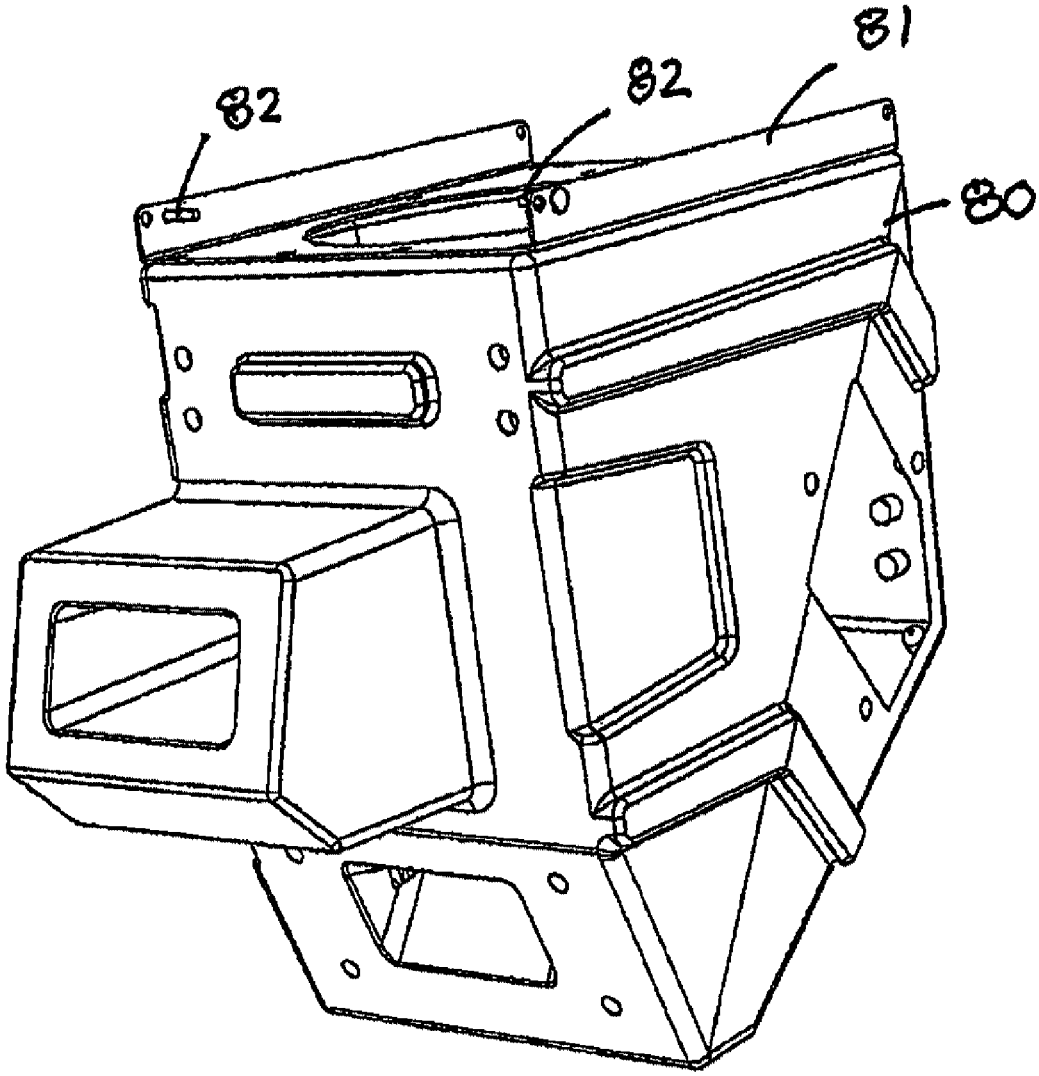
FIG. 8 is a perspective view of a housing of the embodiment of FIG. 1.

FIG. 8 illustrates housing 80 of filter box 18 and filter box cover 81. Cover 81 is secured to housing 80 in this example via threaded fasteners. Pin-shaped components 82 are included within hinge assemblies 42 and support cover plate 41 and connected components when cover plate 41 is opened, such as during a filter exchange.

Figure 9:
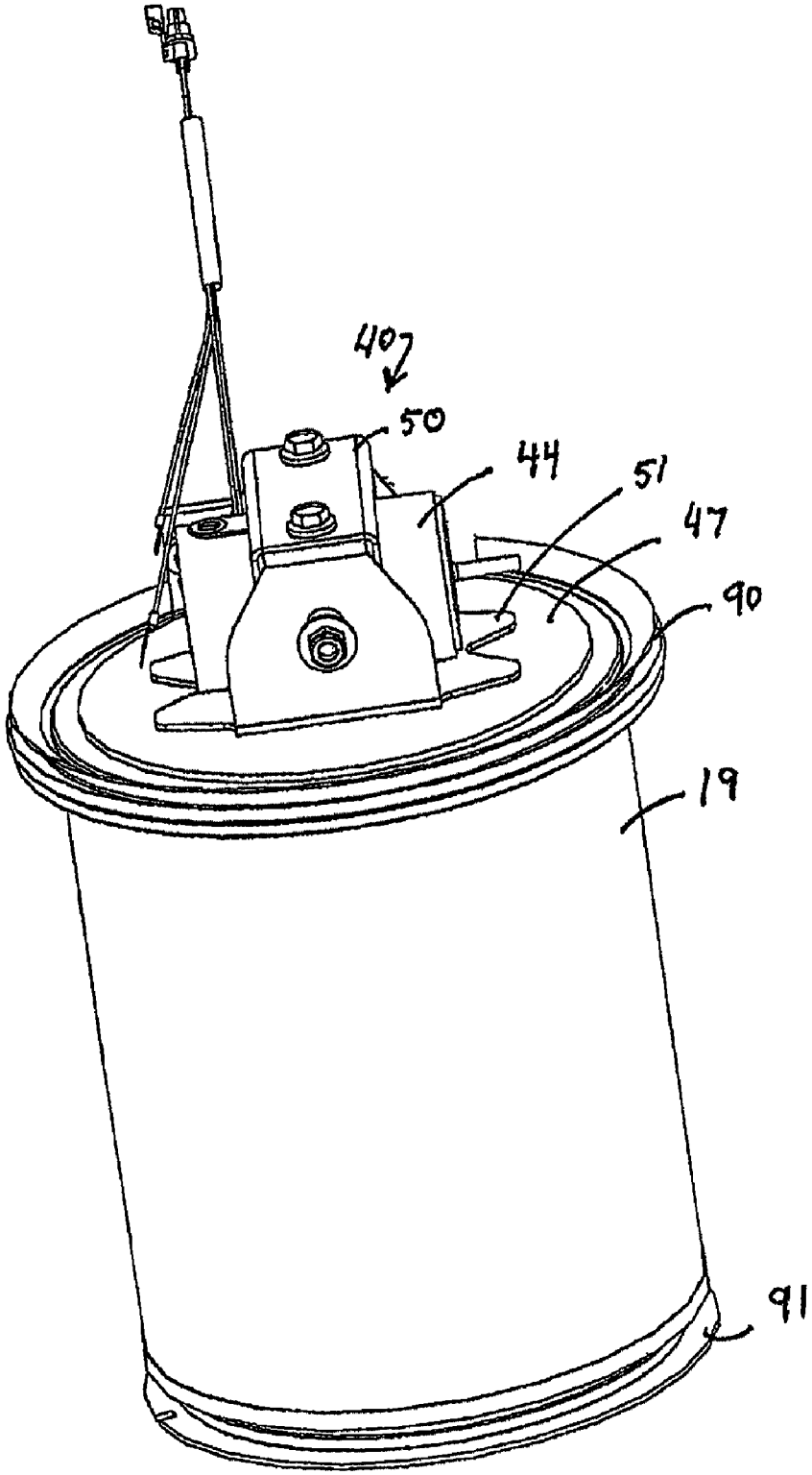
FIG. 9 is a perspective view of a filter and filter shaker mechanism of FIG. 1.

FIG. 9 illustrates components of shaker mechanism 40 and filter 19. In this example, shaker plate 47 is in generally direct contact with one end of filter 19. The opposite end of filter 19 is supported by a base within housing 80 (not shown). Upper annular seal 90 and lower annular seal 91 control air flow through top openings of filter 19.

Figure 10:
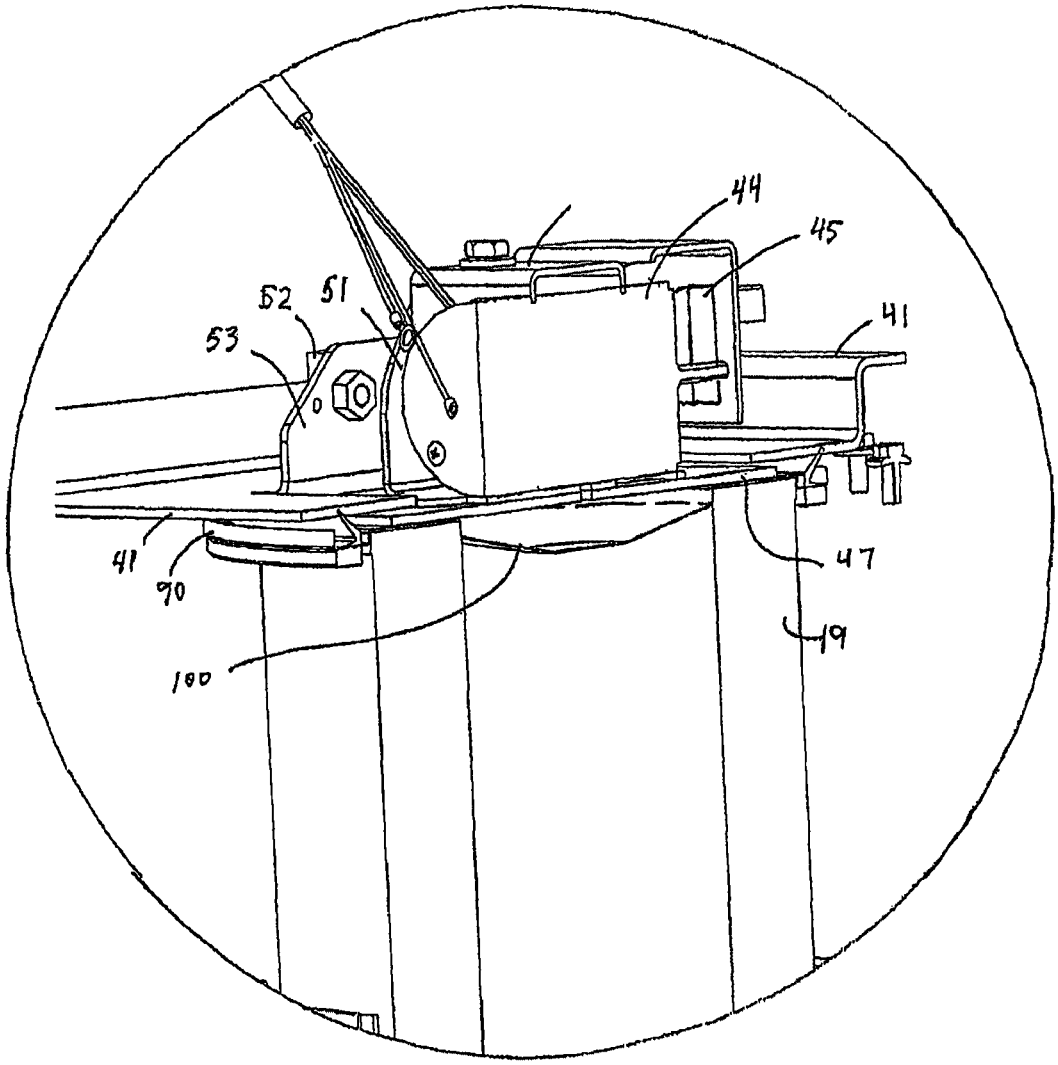
FIG. 10 is a cross sectional view of portions of FIG. 9.

FIG. 10 illustrates a cross sectional view of the shaker mechanism 40 and filter 19 of FIG. 9 in an operational orientation. Top cover 100 is held between a top surface of filter 19 and is in direct contact with shaker plate 47. Upper annular seal 90 is in contact with a lower surface of hinged cover plate 41. Forces generated during rotation of motor 44 and eccentric mass 45 are directly applied to the top of filter 19 and cause filter 19 to shake and dislodge dust and debris on filter 19 surfaces.

Figure 11:
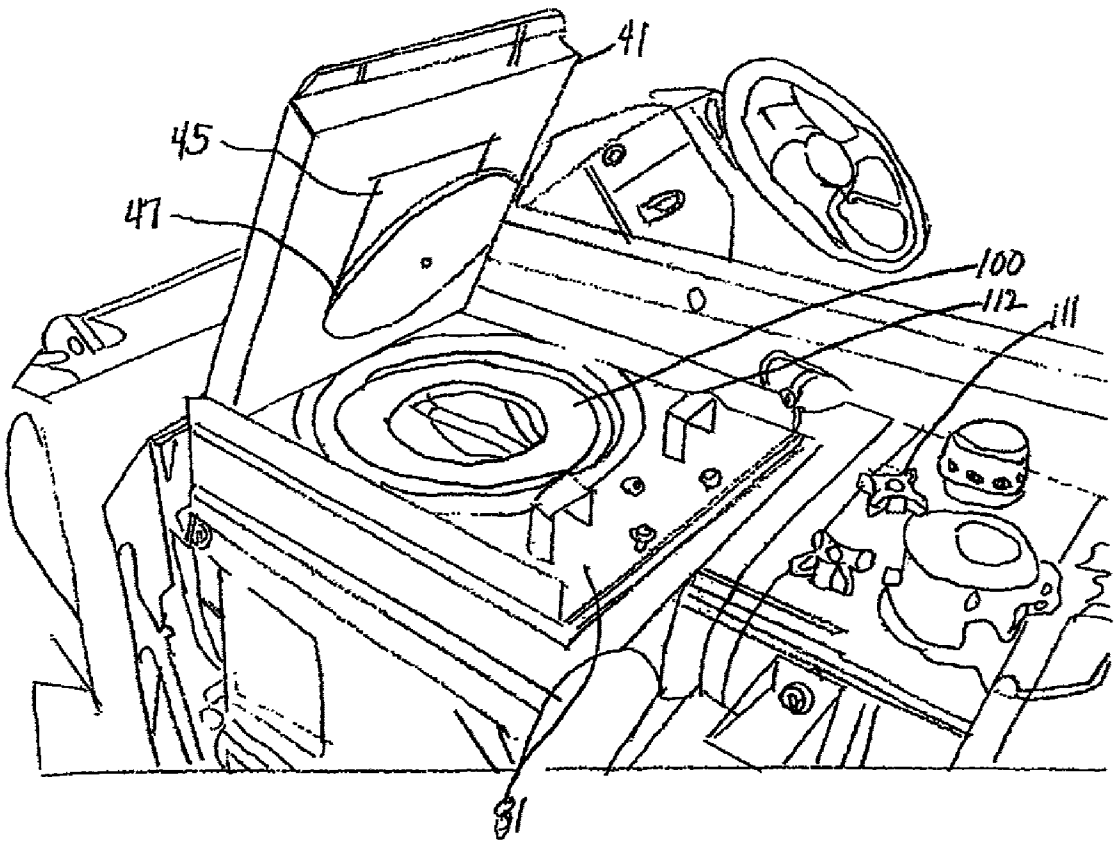
FIG. 11 is a perspective illustration of the machine of FIG. 1.

FIG. 11 illustrates hinged cover plate 41 and connected components in an opened orientation, such as during inspection or replacement of filter 19. Clamp assemblies 43 include knobs 111 which are secured on threaded fasteners 112 held above filter box cover 81. As depicted, removal of knobs 11 from threaded fasteners 112 permits opening of cover plate 41 and access to filter 19.

Figure 12:
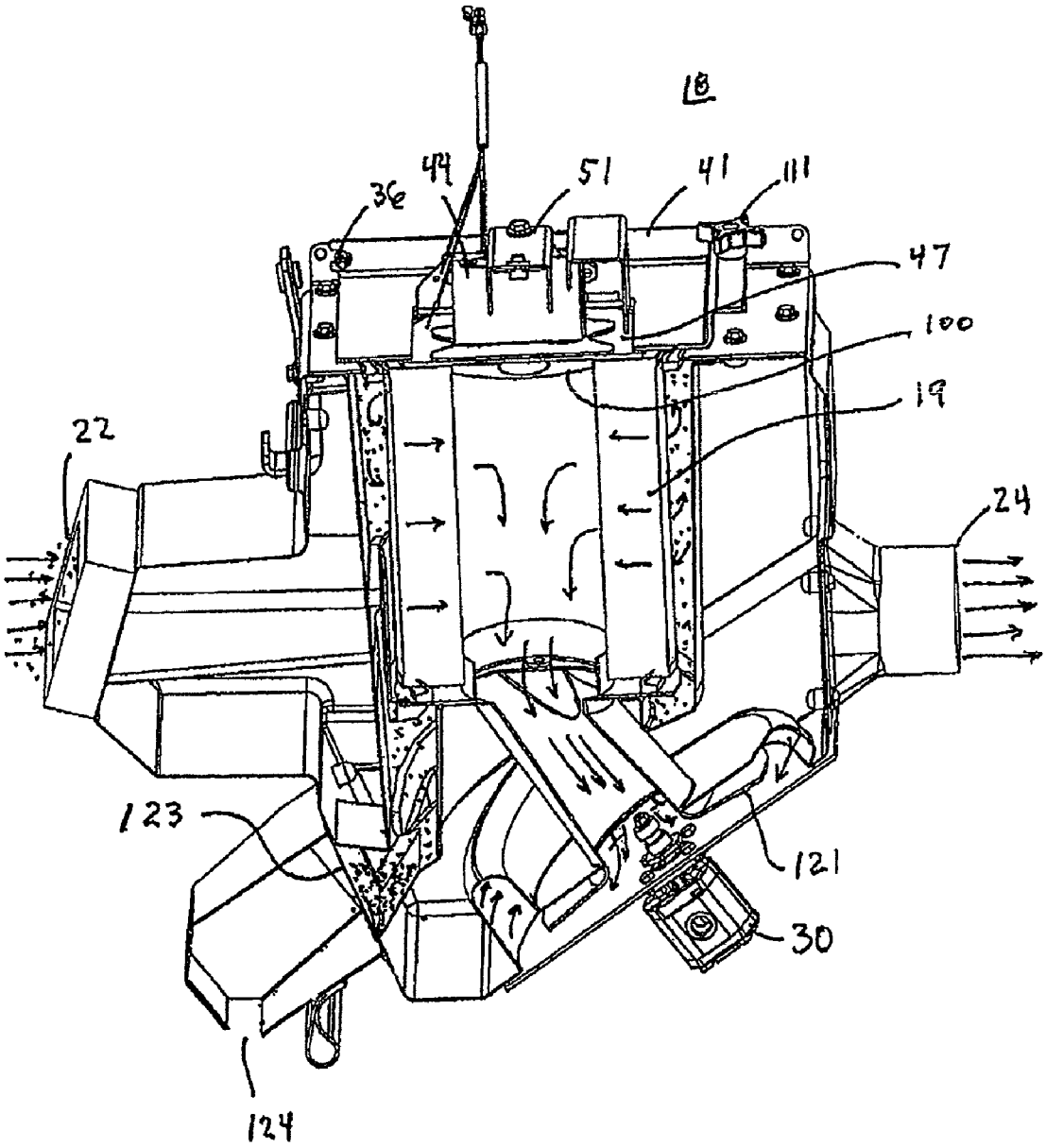
FIG. 12 is a depiction of components of FIG. 1 during operation.

FIG. 12 is a cross-sectional operational depiction of filter box 18 with airflows generally indicated by arrows. In operation, dusty airflow passes first through prefilter 17 and enters filter box 19 at intake opening 22. Air is drawn through filter box 18 upon activation of impeller 121 which is driven by vacuum fan motor 30 and exhausted toward the rear of the machine at air outlet 24. This is a preferred arrangement because the air is cleaned before it passes through the vacuum impeller, which reduces abrasive wear on the impeller. However, some sweepers pass the air first through the blower and then through the filters. This arrangement can also be accommodated by the invention.

During machine 10 operation, dust and debris accumulates near debris outlet 23. Flap or seal 123 is held closed by vacuum action during machine 10 use. In the absence of impeller 121 rotation, debris forces open seal 123 and falls out of hopper box 18 through opening 124. In one example, opening 124 is located near an end of extension conduit 125 which is at least partially located within front hopper 13 of machine 10. Dust and debris falling out of filter box 18 is directed through extension 125 and drops through opening 124 onto a surface of hopper 13.

During a filter shaking procedure, the motor driven eccentric mass 45 imparts a vibratory motion to filter 19 to dislodge an accumulation of dust and debris. Various means for initiating a cleaning cycle can be envisioned. In one preferred embodiment, shaker motor 44 is activated after each time the vacuum system is turned off. In another embodiment, shaker motor 44 is controlled via a machine controller in response to differential pressure changes across filter 19. A pressure switch for sub-atmospheric pressure may also be installed at filter box 18, with one of its pressure ports connected to the duct leading to the exhaust fan and its other pressure port open to atmosphere. In normal service, as dust gradually accumulates on the filters, the differential pressure will rise. When it reaches a predetermined value the pressure switch will signal a controller to initiate an automatic filter cleaning cycle.

Figure 13:
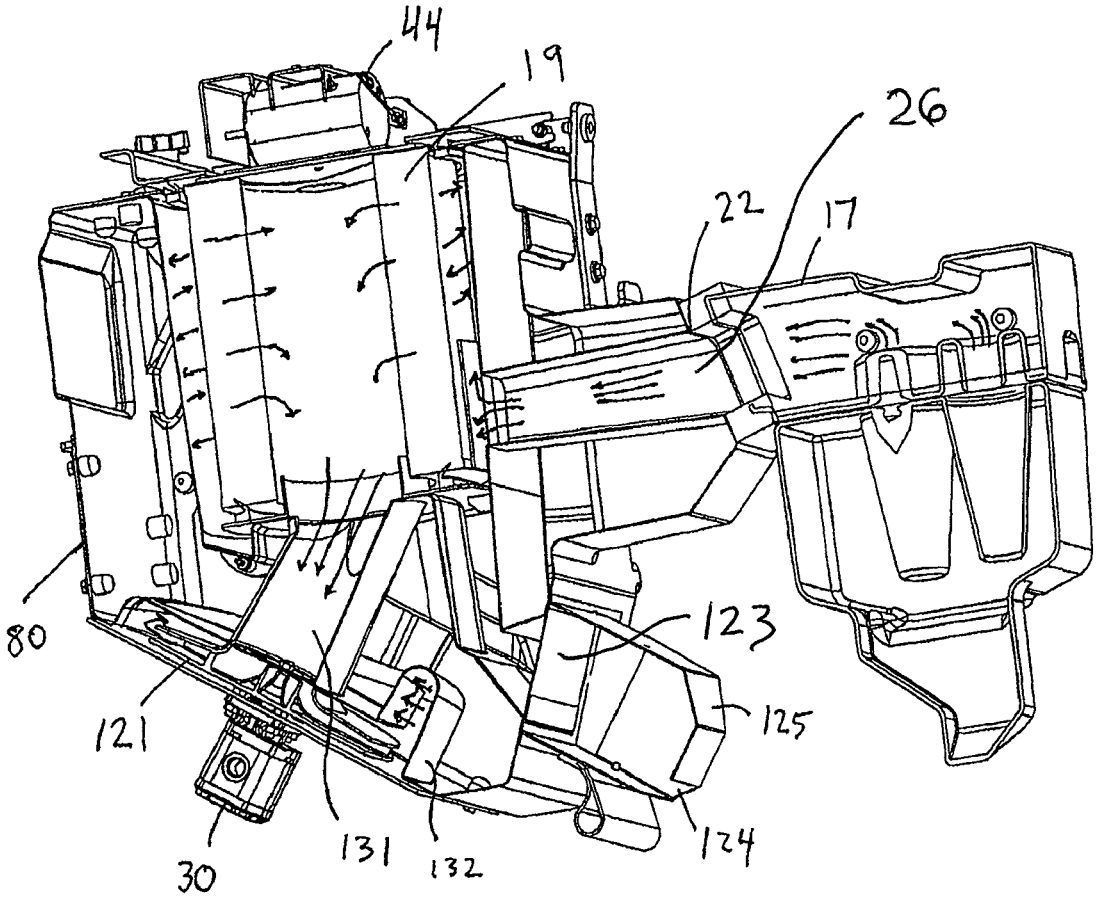
FIGS. 13 and 14 are depiction of a filter box and prefilter during machine operation.
Figure 14:
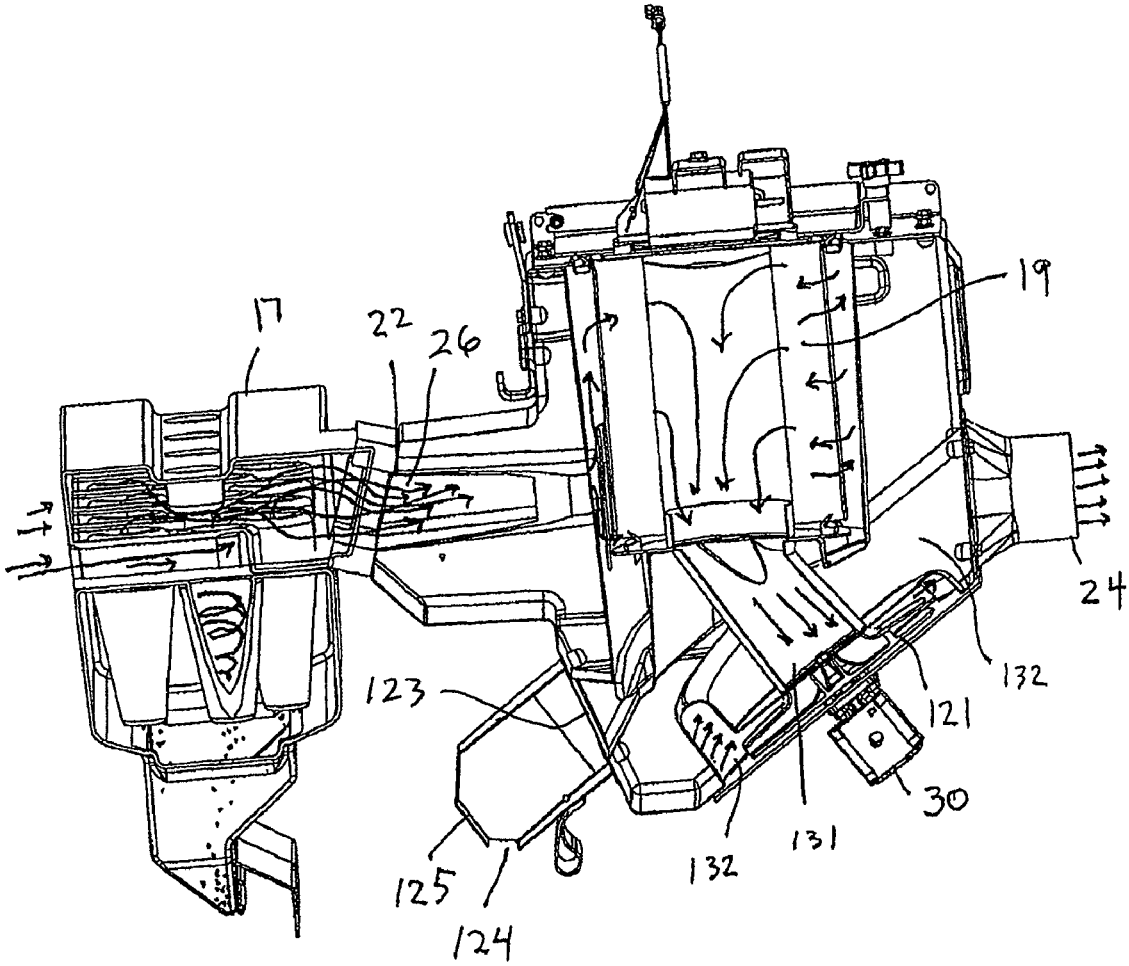

FIGS. 13 and 14 are cross-sectional operational depictions of filter box 18 and prefilter 17 showing airflows generally indicated by arrows. In operation, dusty airflow passes first through prefilter 17 and enters filter box 19 at intake opening 22 via air conduit 26. During machine operation, air is drawn through the air conduit 26 and into the filter box 18 upon activation of impeller 121 which is driven by vacuum fan motor 30 and exhausted toward the rear of the machine at air outlet 24. In addition to containing cylindrical filter 19, filter box 18 also defines a vacuum fan housing for drawing air through filter and conduit 131 and directing air out through conduit 132 which has an expanding cross section as conduit 132 travels from impeller 121 to outlet 24. In one example of the invention, filter box 18 is a rotationally molded polymer component.

Figure 15:
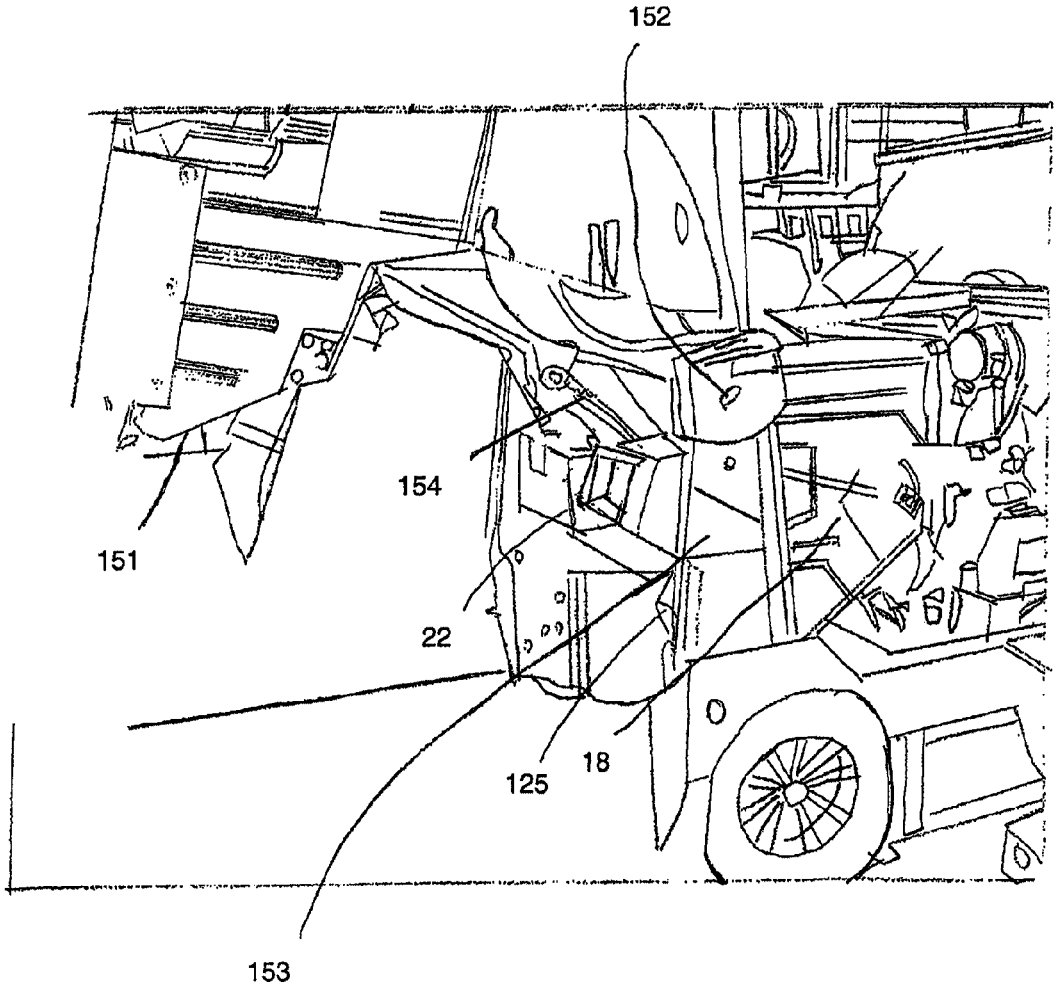
FIGS. 15-17 illustrate the machine 10 of FIG. 1 with a hopper in an upright, dumping orientation.

FIG. 15 illustrates hopper 13 lifted into a dumping orientation whereby dirt and debris exits hopper 13 through opening 151. During a sweeping operation, brush 11 throws dirt and debris through opening 151. Hopper 13 is pivots about hinges 152 on machine arms 153 via hydraulic cylinder 154. As shown in the drawing, filter box 18 and prefilter 17 are separated when the hopper 13 is lifted. Fluid coupling between prefilter 17 and filter box 18 is restored when hopper 13 is lowered.

Figure 16:
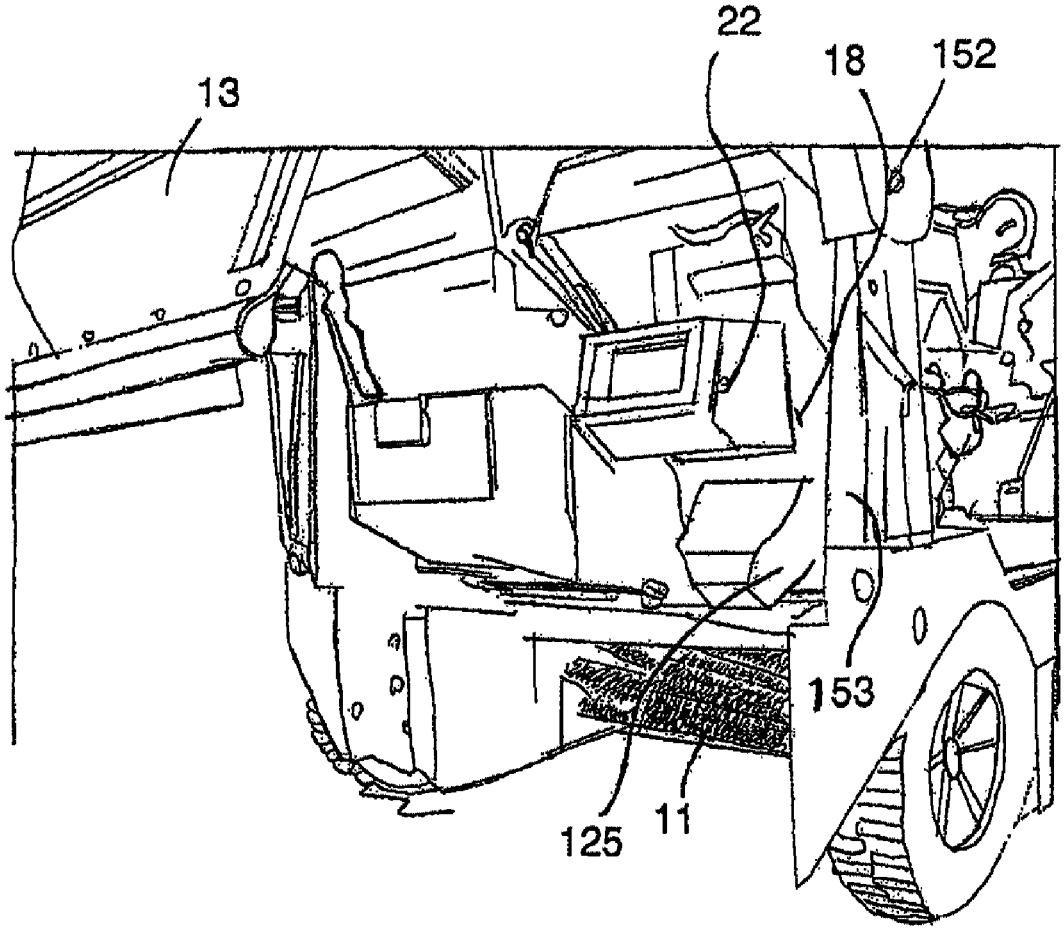

FIG. 16 is another illustration of hopper 13 lifted into an upright orientation. In this view, brush 11 is visible as is extension conduit 125, through which dust and debris flows from filter box 18 and is captured within hopper 13 during normal operation. As apparent, two couplings are made between hopper 13 and external filter box 18 during normal operation. A first coupling permits dusty air to flow into opening 22 and a second coupling allows dust and debris to flow from filter box 18 through conduit 125 and onto a surface of the hopper 13.

Figure 17:
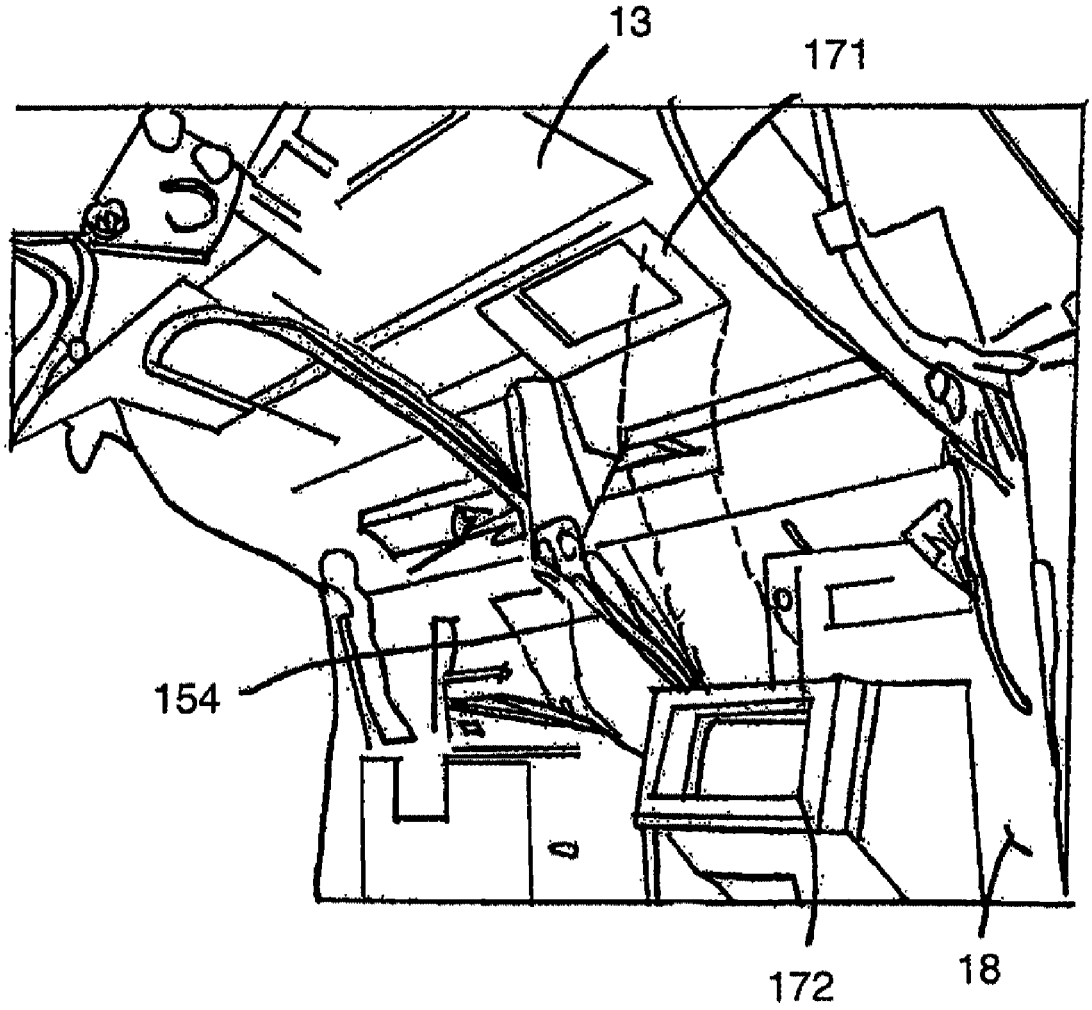

FIG. 17 is another illustration of hopper 13 lifted into an upright orientation relative to filter box 18. Visible in this view is the outlet 171 of prefilter 17 which mates with a coupling 172 at opening 22 of filter box 18. Coupling 172 may be a foam or other resilient material for containing airflow within the vacuum system.

As a cost reduction a pressure switch and control system might be eliminated, leaving only a manual pushbutton to activate shaker motor 44. In this configuration the operator would still have to watch for signs of dirty filters, such as dust starting to come out from under the brush skirts. At that point he or she could push the pushbutton and the cleaning cycle would proceed t its completion. This would retain the advantage of cleaning the filters without interrupting the sweeping operation and without shutting off the dust control air flow, and it would simplify the operator's job. It would also be possible to replace the pressure switch with a timer, while retaining all other features of the system as described. The cleaning cycle could be activated by the timer at predetermined time intervals. This would provide filter cleaning with no attention from the operator and without interrupting sweeping or dust control.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A filter system for a mobile surface maintenance machine comprising:

a hopper adapted to receive debris thrown from a sweeping brush, said hopper capable of being lifted during a dumping procedure;

a filter box containing at least one filter and being externally provided relative to the hopper, said filter box being connected to the machine at a location away from the hopper, said filter box being in selective air communication with the hopper so as to support a vacuumbased airflow through the hopper and said at least one filter when the hopper is lowered into an operational configuration, and during said dumping procedure said hopper is separated from and raised away from the filter box, wherein a vacuum impeller connected to the filter box draws air through the hopper and the filter, said filter box defining air conduits for directing filtered air out of the filter box; and a filter shaking mechanism to dislodge dust and debris from a surface of the filter, and said dust and debris accumulating on a bottom surface of the filter box.

2. The system of claim 1 wherein the dust and debris of the filter box are selectively passed through an opening for deposit onto a hopper surface.

3. The system of claim 2 wherein a movable flap, biased by operation of the vacuum impeller, controls the flow of dust and debris through the opening and into the hopper.

4. The system of claim 3 wherein the flap is drawn closed during machine operation to prevent airflow through the opening.

5. A filtration system for a mobile surface maintenance machine comprising:

a hopper receiving debris from a sweeping brush and being lifted upward away from the brush during a hopper dumping procedure;

a filter box housing a filter and connected to the machine at a location away from the hopper, with the hopper being separated from the filter box during said hopper dumping procedure;

a vacuum fan drawing air from the hopper through the filter;

an air conduit connecting the hopper to the filter box during machine operation so that dusty air from inside the hopper can flow into said filter box, said conduit being broken during a hopper dumping procedure and reestablished when the hopper dumping procedure is complete; and a filter shaking assembly for dislodging debris from the filter.

6. The system of claim 5 wherein the conduit extends between the filter box and an outlet of a prefilter assembly carried by the hopper.

7. The system of claim 6 wherein an opening of the filter box is sealed against an exhaust opening of the prefilter assembly with a flexible coupling.

8. The system of claim 5 further comprising a debris conduit between the filter box and the hopper, said debris conduit passing dislodged debris from the filter box into the hopper.

9. The system of claim 8 wherein the flow of debris through the debris conduit is controlled by a movable seal.

10. The system of claim 9 wherein the seal responds to air pressure to permit or prevent flow through the debris conduit.

11. A surface maintenance machine comprising:

a hopper connected to a wheeled chassis, said hopper being lifted away from a ground surface during a dumping procedure;

a filter box connected to the chassis and being in selective air communication with the hopper, said filter box remaining stationary relative to the chassis during said dumping procedure;

a vacuum fan connected to the chassis, said fan drawing air through the hopper and filter box during a surface cleaning operation, and said air communication being broken upon the hopper being lifted; and a filter box debris outlet, wherein the debris outlet directs a release of debris from the filter box into the hopper, and wherein the debris outlet includes a movable flap, said flap responding to pressure variations between the filter box interior and atmosphere.

12. The machine of claim 11 further comprising a prefilter assembly carried by the hopper, wherein air flows through the prefilter and into the filter box during the surface cleaning operation.

13. The machine of claim 12 wherein a conduit extends between the prefilter assembly and the filter box, said conduit being broken when the hopper is lifted and being reestablished when the hopper is lowered.

14. A surface maintenance machine comprising:

a hopper receiving debris thrown from a sweeping brush, with said hopper being movably supported upon a chassis of the machine;

a filter box having a filter therein and including an inlet port and an outlet port, with said filter box being separated from the hopper during a hopper dumping procedure;

a vacuum source adapted to draw air through the hopper and filter box;

a first conduit between the filter box and the hopper, said first conduit being broken when the hopper is moved away from the sweeping brush during the hopper dumping procedure and being reestablished when the hopper is moved back; and a second conduit between the filter box and the hopper, said second conduit directing debris from the filter box into the hopper, and wherein the second conduit is selectively controlled by a movable flap.

15. A filtration system for a mobile surface maintenance machine comprising:

a hopper carried by the surface maintenance machine and receiving debris from a sweeping brush, said hopper being movably supported on a chassis of the machine between an operating orientation and a dumping orientation;

a filter box in communication with the hopper when the hopper is in said operating orientation and being separated from communication with the hopper when the hopper is in the dumping orientation;

a vacuum impeller attached to the filter box and drawing air from the hopper through the filter box;

a cylindrical filter housed within the filter box; and a filter shaking mechanism for dislodging debris from the filter.

16. The system of claim 15 further comprising a conduit for directing dislodged debris into the hopper.

17. The system of claim 16 wherein the conduit is selectively controlled by a movable flap in response to pressure variations between the filter box and atmosphere.

18. The system of claim 15 further comprising a prefilter assembly.

19. The system of claim 18 wherein the prefilter assembly is carried by the hopper.

20. A filtration system for a mobile surface maintenance machine comprising:

a hopper receiving debris from a sweeping brush of the machine;

a filter box disposed away from the hopper and carrying at least one cylindrical filter, wherein the hopper is moved away from the filter box during a hopper dumping procedure, and with an airflow between the hopper and filter box being separated during said hopper dumping procedure;

vacuum means for drawing air through the hopper and filter box when the hopper is in an operating orientation;

conduit means for providing fluid communication between the filter box and the hopper during a sweeping operation with the hopper in the operating orientation; and a filter shaking mechanism for dislodging debris from the filter.

21. The system of claim 20 wherein said conduit means includes an air conduit between the hopper and the filter box, said conduit means also interrupting air flow from the filter box and the hopper during said hopper dumping procedure.

* * * * *